US009027172B2

(12) United States Patent
Fima

(10) Patent No.: US 9,027,172 B2
(45) Date of Patent: May 12, 2015

(54) DRAIN VALVE CORE

(76) Inventor: Giovanni Fima, Oceanside, CA (US)

( * ) Notice: Subject to any disclaimer, the term of this patent is extended or adjusted under 35 U.S.C. 154(b) by 642 days.

(21) Appl. No.: 13/356,957

(22) Filed: Jan. 24, 2012

(65) Prior Publication Data

US 2012/0167295 A1 Jul. 5, 2012

Related U.S. Application Data

(63) Continuation-in-part of application No. 12/900,785, filed on Oct. 8, 2010, now Pat. No. 7,900,288, which is a continuation-in-part of application No. 12/765,123, filed on Apr. 22, 2010, now abandoned, which is a continuation-in-part of application No. 12/154,891, filed on May 28, 2008, now abandoned.

(60) Provisional application No. 61/437,358, filed on Jan. 28, 2011, provisional application No. 61/175,705, filed on May 5, 2009, provisional application No. 61/175,831, filed on May 6, 2009, provisional application No. 61/177,150, filed on May 11, 2009, provisional application No. 61/262,981, filed on Nov. 20, 2009, provisional application No. 61/289,633, filed on Dec. 23, 2009, provisional application No. 60/932,700, filed on Jun. 1, 2007.

(51) Int. Cl.

| | |
|---|---|
| ***A47K 1/14*** | (2006.01) |
| ***E03D 13/00*** | (2006.01) |
| ***E03C 1/298*** | (2006.01) |
| *E03C 1/262* | (2006.01) |

(52) U.S. Cl.

CPC ..... *E03D 13/007* (2013.01); *A47K 1/14* (2013.01); *E03C 1/262* (2013.01); *E03C 1/298* (2013.01)

(58) Field of Classification Search

CPC ..... E03C 1/298; E03C 1/262; A47K 1/14
USPC ..... 4/286, 287
See application file for complete search history.

(56) References Cited

U.S. PATENT DOCUMENTS

| | | | | |
|---|---|---|---|---|
| 1,137,516 | A | 4/1915 | Moon | |
| 2,199,673 | A | 5/1940 | Ronning | |
| 2,912,999 | A | 11/1959 | Kersh | |
| 2,913,000 | A * | 11/1959 | Roberts | 137/854 |
| 3,903,922 | A | 9/1975 | Buckman | |
| 3,911,949 | A * | 10/1975 | Hilden et al. | 137/854 |
| 3,934,596 | A | 1/1976 | Suntheimer et al. | |
| 4,088,149 | A | 5/1978 | Logson | |
| 4,147,630 | A * | 4/1979 | Laval, Jr. | 210/137 |

(Continued)

FOREIGN PATENT DOCUMENTS

| | | |
|---|---|---|
| EP | 0470518 | 5/1994 |
| WO | 00/03099 | 1/2000 |

(Continued)

*Primary Examiner* — Huyen Le
(74) *Attorney, Agent, or Firm* — Fish & Tsang, LLP

(57) ABSTRACT

Various embodiments of a device for regulating a fluid flow are described that can include first and second downwardly-sloping valves that are biased in a closed position to prevent odors from escaping the device. The device can also include first and second downwardly-sloping valve seats, and configured such that an end portion of the first valve can be seated beneath the first valve seat and an end portion of the second valve can be seated beneath the second valve seat when the first and second valves are in a closed position, respectively.

17 Claims, 10 Drawing Sheets

(56) References Cited

U.S. PATENT DOCUMENTS

| | | | | |
|---|---|---|---|---|
| 4,180,875 | A | 1/1980 | Wilson | |
| 5,601,112 | A * | 2/1997 | Sekiya et al. | 137/512.15 |
| 5,711,037 | A | 1/1998 | Reichardt et al. | |
| 6,053,197 | A | 4/2000 | Gorges | |
| 6,273,124 | B1 | 8/2001 | Huber et al. | |
| 6,286,153 | B1 | 9/2001 | Keller | |
| 6,401,266 | B1 | 6/2002 | Mitchell et al. | |
| 6,640,350 | B1 | 11/2003 | Deutsch | |
| 6,644,339 | B2 | 11/2003 | Gorges | |
| 6,666,966 | B1 | 12/2003 | Schluttig | |
| 6,959,723 | B2 | 11/2005 | Gorges | |
| 6,973,939 | B2 | 12/2005 | Gorges et al. | |
| 7,900,288 | B2 * | 3/2011 | Fima | 4/287 |
| 2004/0194198 | A1 | 10/2004 | Casari | |
| 2005/0257315 | A1 * | 11/2005 | Hung | 4/295 |
| 2006/0101565 | A1 | 5/2006 | Cummings | |
| 2006/0207005 | A1 | 9/2006 | Janssen | |
| 2008/0295233 | A1 | 12/2008 | Fima | |

FOREIGN PATENT DOCUMENTS

| | | |
|---|---|---|
| WO | 2009/040524 | 4/2009 |
| WO | 2010/129531 | 11/2010 |

* cited by examiner

DRAIN VALVE CORE

This application claims the benefit of priority to U.S. provisional application having Ser. No. 61/437,358 filed on Jan. 28, 2011. This application is also a continuation-in-part of U.S. utility application having Ser. No. 12/900,785 filed Oct. 8, 2010, which is a continuation-in-part of U.S. utility application having Ser. No. 12/765,123 filed Apr. 22, 2010 which claims priority to U.S. provisional applications having Ser. No. 61/175,705 filed on May 5, 2009, Ser. No. 61/175,831 filed on May 6, 2009, Ser. No. 61/177,150 filed on May 11, 2009, Ser. No. 61/262,981 filed on Nov. 20, 2009, and Ser. No. 61/289,633 filed on Dec. 23, 2009, and is also a continuation-in-part of U.S. patent application Ser. No. 12/154,891 filed on May 28, 2008, which claims priority to U.S. provisional patent application with Ser. No. 60/932,700 filed on Jun. 1, 2007.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply

FIELD OF THE INVENTION

The field of the invention is drain valves.

BACKGROUND

Urinals and other drains typically include a seal to contain gases and odors that develop in the drain system. Typical seals include the well known P-traps or S-traps, in which a residual portion of water forms a seal that effectively locks in odors downstream of the seal. Because the seal's upward surface communicates freely with the environment, it generally requires frequent flushing to prevent odors emanating from the seals. Unfortunately, the need for frequent flushing can consume large amounts of water, which can be problematic especially in areas with limited or no access to water.

To eliminate the need for a trap seal in urinals, various types of waterless urinals have been implemented that minimizes the amount of water used. One type of waterless urinals utilizes cartridges having a low-density sealant that floats on a body of trapped residual urine. The seal serves as an odor barrier by allowing urine to permeate through the sealant while preventing downstream odors from emanating through the seal. Such cartridges are described in U.S. Pat. No. 5,711,037 to Reichardt et al., U.S. Pat. No. 6,053,197 to Gorges, U.S. Pat. No. 6,644,339 to Gorges et al., U.S. Pat. No. 6,959,723 to Gorges, and U.S. Pat. No. 6,973,939 to Gorges et al. Unfortunately, the low-density sealant is open to the atmosphere, and odors can permeate through the seal as the sealant becomes depleted. In addition, these cartridges require periodic replacement, adding significantly to the waterless urinals' cost especially in high traffic areas such as airports and stadiums. Furthermore, the used cartridges are often hazardous and generally require a special tool, gloves, and masks for removal.

Instead of chemical sealants, it is known to utilize a duck bill valve, such as those described in U.S. Pat. No. 6,401,266 to Mitchell et al.; U.S. Pat. Appl. No. 2006/0010565 to Cummings (publ. May 2006); U.S. Pat. Appl. No. 2006/0207005 to Janssen (publ. September 2006); and WIPO Patent Appl. No. 2009/040524 to McAlpine (publ. April 2009). However, the duck bill valves typically retain a small amount of fluid after each use leading to odors, and are prone to freezing in cold regions, and sticking. In addition, such systems utilize only a single duck bill valve, which can be problematic if the valve is stuck open due to sticking, freezing, debris, or otherwise.

It is also known to use an umbrella valve in a urinal, such as that described in U.S. Pat. No. 4,180,875 to Wilson. However, the Wilson system is problematic as the system also utilizes a single valve and lacks a removable core, which increases the time and cost for cleaning and maintenance of the system.

While other types of fluid check valves are known, such as that described in U.S. Pat. No. 2,912,999 to Kersh, the valves lack downwardly-sloping valve seats to help protect against backflow from the drain.

Thus, there is still a need for a device having at least two valves capable of operating in a closed system without the need for a chemical sealant.

SUMMARY OF THE INVENTION

The inventive subject matter provides apparatus, systems and methods for regulating a fluid flow through a drain. As used herein, the term "drain" means a fluid outlet such as that found in urinals, sinks, tubs, floor drains, or other drains through which fluid can flow. A preferred apparatus includes dual downwardly-sloping, gravity flow valves, each of which is configured to each be biased in a closed position. As used herein, the term "gravity flow valve" means a valve in which the fluid flows through the valve primarily as a result of the force of gravity. Thus, each of the valves can remain closed unless opened when a pressure of a fluid on an upper surface of the valve exceeds a predetermined threshold, which advantageously reduces or eliminates any downstream odors flowing past the valves. This is beneficial because the valves open when fluid is present on the surface of the valve, but otherwise remain closed.

The apparatus can further include first and second downwardly-sloping valve seats, such that when each valve is in a closed position, the valve is seated against a valve seat. Thus, in contrast to prior art devices, seating each valve against downwardly-sloping valve seats helps to eliminate the possibility of backflow from passing through the valves.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

Various objects, features, aspects and advantages of the inventive subject matter will become more apparent from the following detailed description of preferred embodiments, along with the accompanying drawing figures in which like numerals represent like components.

DETAILED DESCRIPTION

One should appreciate that the disclosed techniques provide many advantageous technical effects that include eliminating the need for flushing water while avoiding the problems associated with cartridges having low-density sealants. However, and in contrast to urinal cartridges having a low-density sealant, the inventive subject matter described herein can be used in urinals and other drains that utilize water to flush the drain, or chemicals to clean the drain housing and cartridge, without degradation of the valves or odor seal.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1A:
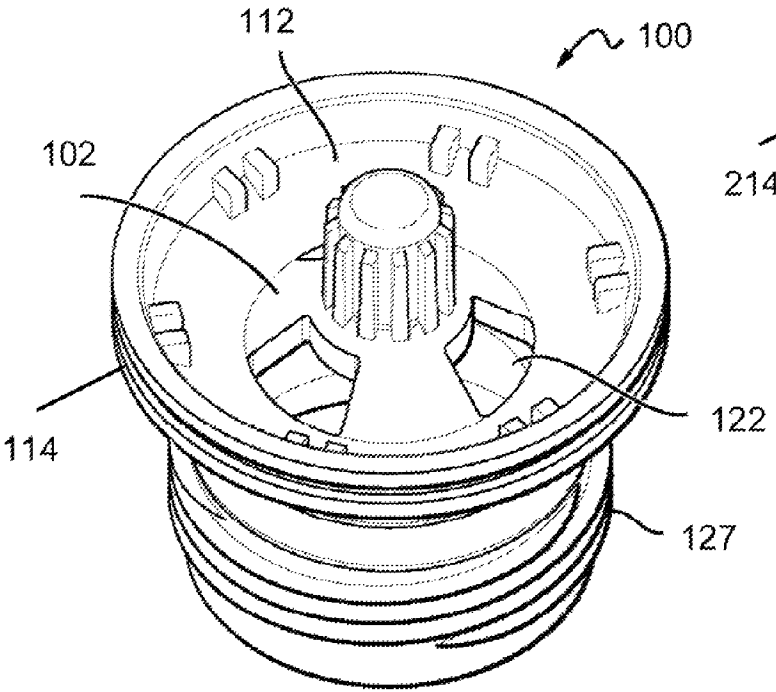
FIGS. 1A-1C are a top perspective view, a vertical cross-sectional view, and an exploded view, respectively, of one embodiment a device for regulating fluid flow through a drain.
Figure 1B:
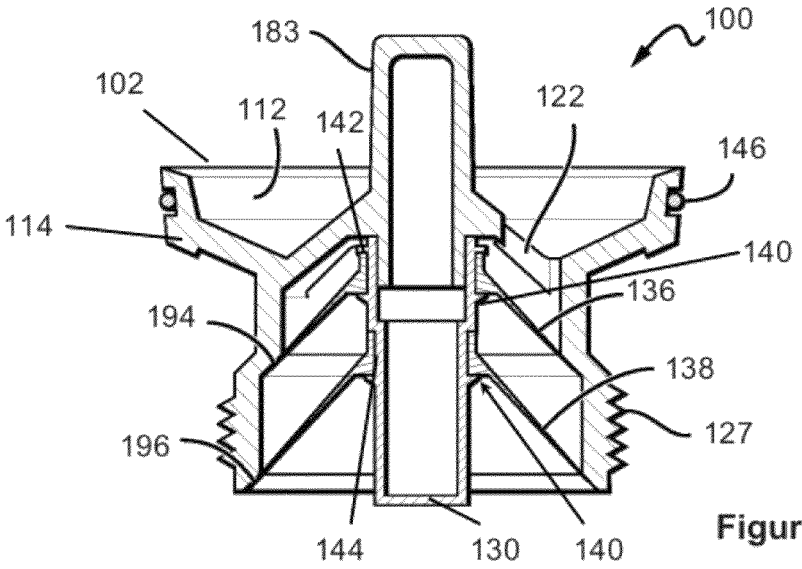
Figure 1C:
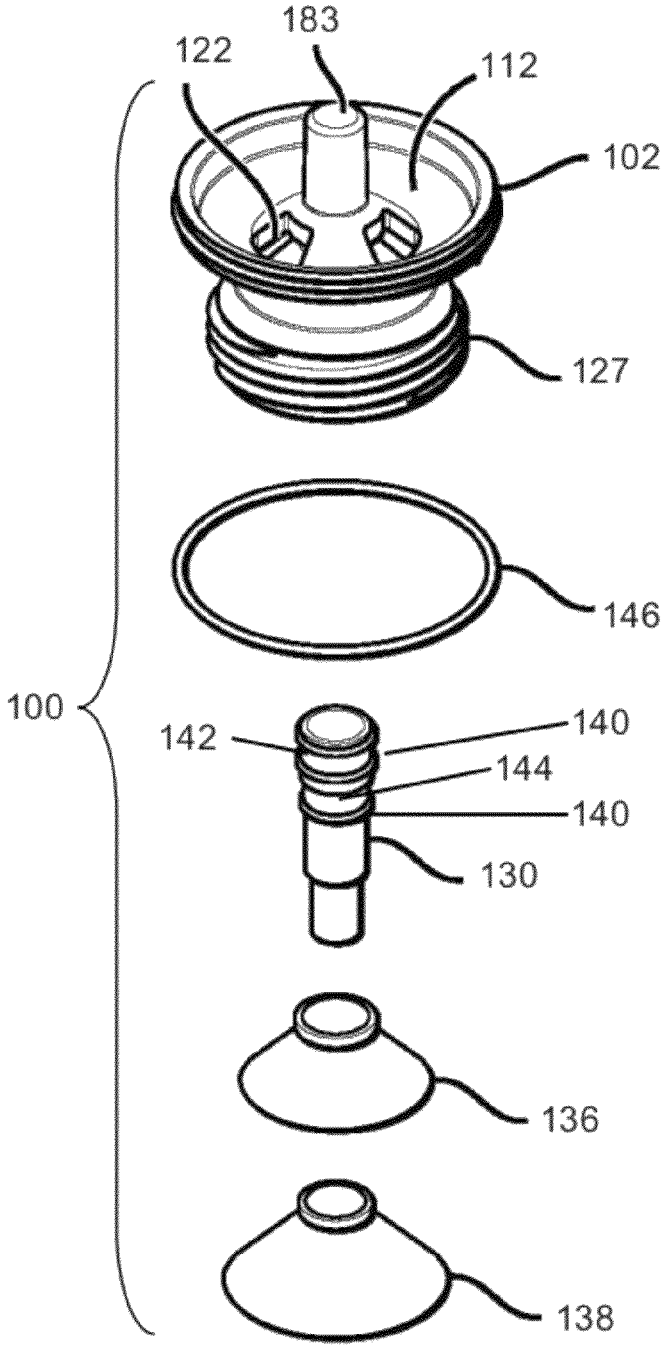

In FIGS. 1A-1C, one embodiment of a device 100 is shown for regulating a fluid flow through a drain that includes a housing 102 having multiple openings 122 disposed on an upper surface 112 of the housing 102. It is contemplated that the upper surface 112 can be downwardly sloped to direct fluid toward openings 122. The housing 102 can be composed of any commercially suitable material(s) including, for example, plastics and other polycarbonates, metal, quartz, porcelain, and any combination(s) thereof.

In some contemplated embodiments, housing 102 can be sized and dimensioned to fit within a drain such as those found in sinks, urinals, and floor drains, for example. However, it is alternatively contemplated that the device 100 can be sized and dimensioned to fit within a cartridge. Although housing 102 preferably has a horizontal cross-section that is circular in shape, the shape of the housing 102 can be varied to correspond to the shape of the drain or cartridge.

Device 100 can include an outwardly projecting flange 114 that can be used to allow the device 100 to rest on a portion of a cartridge or drain. Optionally, a pliable plastic or elastomeric seal ring 146 can be disposed about at least a portion of the flange 114 to create a fluid seal. Device 100 can further include threads 127 that are configured to mate with threads of a drain or cartridge, such that the device 100 can be secured in place. In this manner, the device 100 can be removably threaded and thereby secured or removed from, a drain or cartridge. However, other commercially suitable fasteners could be substituted for threads 127 such that the device 100 can be secured in place.

Device 100 can advantageously include first and second valves 136 and 138 disposed in housing 102, which are configured to prevent odors from emanating from downstream of the device 100. Thus, contrary to prior art systems having a single valve including, for example, U.S. Pat. No. 6,401,266 to Mitchell et al.; U.S. Pat. Appl. No. 2006/0010565 to Cummings (publ. May 2006); U.S. Pat. Appl. No. 2006/0207005 to Janssen (publ. September 2006); and WIPO Patent Appl. No. 2009/040524 to McAlpine (publ. April 2009), the dual valve system provides additional protection against the escape of odors from a drain pipe. For example, even if the primary first valve 136 was somehow stuck open by a toothpick or other debris, the secondary valve 138 would still prevent downstream odors from escaping through the device 100.

Preferably, each of the valves 136 and 138 is coupled to a stem 130, and in some contemplated embodiments, the stem 130 can extended through each of the valves 136 and 138. Optionally, as shown in FIG. 1B, the stem 130 can include a bump or extended portion 140 disposed beneath each of the valves 136 and 138. The humps or extended portions 140 can help support the valves 136 and 138, especially where the valves have a diameter greater than 4" or a thickness that is sufficiently thin to cause the valves 136 and 138 to otherwise collapse under normal flow. Alternatively or additionally, stem 130 can include first and second recessed portions 142 and 144 sized and dimensioned to receive the first and second valves 136 and 138, respectively.

In preferred embodiments, each of the valves 136 and 138 is a gravity flow valve that is biased closed such that the valves 136 and 138 are closed when not in use. Such valves advantageously can operate without electricity, and function to create a closed system, where the valves close automatically once the fluid passes by the valves. The valves 136 and 138 can have a flexible, synthetic membrane that can comprise any commercially suitable material(s) including, for example, silicon fabric or other synthetic and/or flexible materials, or combinations thereof, which provide protection to the valves from significant damage or degradation by urine fluids and cleaning solvents. The valves 136 and 138 can be used to regulate various fluids including, for example, water, urine, and combinations thereof.

Figure 5A:
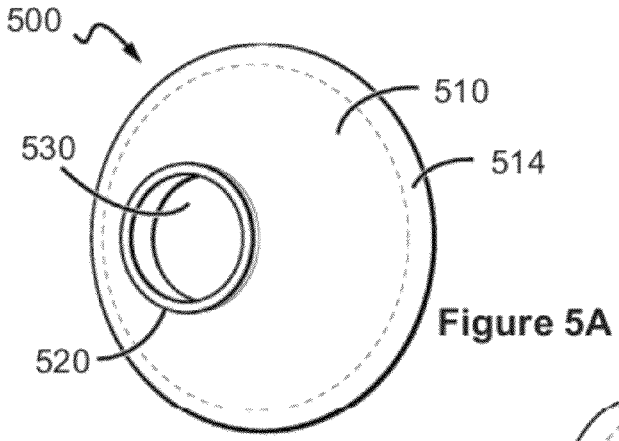
FIGS. 5A-5B are top and bottom perspective views, respectively, of an embodiment of a skirt valve.
Figure 5B:
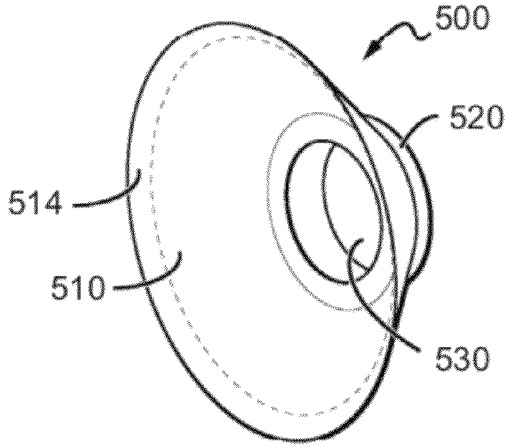
Figure 5C:
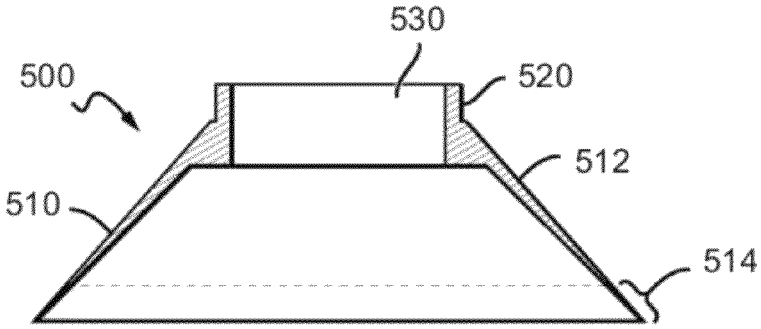
FIG. 5C is a cross-sectional view of the skirt valve of FIGS. 5A-5B.

It is especially preferred that each of the valves 136 and 138 is a skirt valve, which has a downwardly-sloping rim extending from a center portion of the valve where the rim has a flexible outer portion. An exemplary embodiment of a skirt valve is shown in FIGS. 5A-5C. Skirt valves possess numerous advantages over other one-way valves such as umbrella valves and duckbill valves. For example, the skirt valve can be mounted about a stem or post to create a 360 degree opening that is less likely to be jammed by solid items. In addition, the skirt valve typically lacks a spoke to hold the center of the valve in place, and therefore lacks the problems associated with the spokes catching foreign objects. Furthermore, the skirt valve can have a thicker first portion that is coupled to a stem or post of the cartridge, and a thinner second portion that allows for greater flexibility of the valve. In this manner, the skirt valve can be (1) much more rigid than an umbrella valve to (a) keep the valve closed when not in use and (b) prevent back pressure in the drain pipe from opening the valve, while (2) the ends of the skirt valve are flexible to allow for fluid flow.

Although less preferred, other commercially suitable valves could be used including, for example, umbrella valves, duck bill valves, and other flexible valves.

It is especially preferred that the valves 136 and 138 can be disposed within housing 102 such that an end portion of each of valves 136 and 138 is seated beneath first and second downwardly-sloping valve seats 194 and 196 of housing 102, respectively. In this manner, any backflow or pressure beneath the valves 136 and 138 will keep one or both of the valves 136 and 138 pressed against respective valve seats 194 and 196, and thus the valves 136 and 138 remain sealed preventing downstream liquids or gases from flowing past the valves 136 and 138.

The valves 136 and 138 are preferably tapered, such that each valve has a varying thickness along its respective radius. In this manner, the valves 136 and 138 can each comprise a rigid inner portion 137B and 139B with a flexible outer edge interval 137A and 139A, respectively. In some contemplated embodiments, each of the valves 136 and 138 can include an outer edge interval of 5 mm that is sufficiently thin to allow even small amounts of urine or wastewater to pass by valves 136 and 138, while retaining sufficient strength for durability at inner portions 137B and 139B, respectively. Preferably, the outer edge intervals 137A and 139A of the first and second valves 136 and 138 has an average thickness that is less than 95%, and more preferably less than 90%, of an average thickness of the inner portions 137B and 139B, respectively.

In especially preferred embodiments, the outer 5 mm edge interval 137A of the first (upper) valve 136 has a first average thickness that is less than 95% of a second average thickness of the outer 5 mm edge interval 139A of the second (lower) valve 138. As used herein, the term "outer 5 mm edge interval" means the portion extending from the outer edge of the valve inwards by a distance of 5 mm. For example, the outer 5 mm edge interval of a circular valve having a radius (r) of 20 mm is the outer 15-20 mm from a center of the circular valve, or an area represented by the formula: $(\pi*r^2)-(\pi*(r-5)^2)$. In this example, the area would be approximately 549.8 mm. Similarly, the term "outer 1 mm edge interval" means the outer 1 mm edge portion extending about an exterior of the valve. One of ordinary skill in the art would of course understand that square, ovular, and other commercially suitable sizes and dimensions of valves could alternatively be used, and the outer x edge interval would still be applicable.

It is further contemplated that the first average thickness of the outer edge interval could be less than 90%, 85%, 80%, 75%, or 70% of the second average thickness of the second outer 5 mm edge interval 139A. It is further contemplated that the flexible edge interval of the valve could be the outer 1 mm, 3 mm, 7 mm, 10 mm, 15 mm, 20 mm, and so forth, of the valve and will likely depend upon the size and dimension of the valve, and the fluid regulated by the valve.

The thinner outer edge interval 137A of the first valve 136 advantageously ensures that urine will easily flow past the first valve 136 and eliminate residual odors, while the thicker outer edge interval 139A of the second valve 138 ensures that the second valve 138 will remain sealed even if there is backflow or back pressure downstream of the second valve 138.

Each of the valves 136 and 138 can have a circular horizontal cross-section that includes a center portion configured to be anchored to a stem 130. in this manner, ribs are not needed to anchor the valves 136 and 138, which ensures that solids such as cigarettes, hair, and chewing gum are less likely to clog the device 100. In optional embodiments, the device 100 can further include a cap (not shown) coupled to the stem 130.

The second valve 138 can be disposed downstream of the first valve 136, and is preferably separated from the first valve 136 by a distance of less than six inches, more preferably less than three inches, and more preferably, less than one inch. All commercially suitable configurations are contemplated for the first and second valves 136 and 138, and preferably, the valves 136 and 138 are biased to be convex in the upstream direction.

Figure 2:
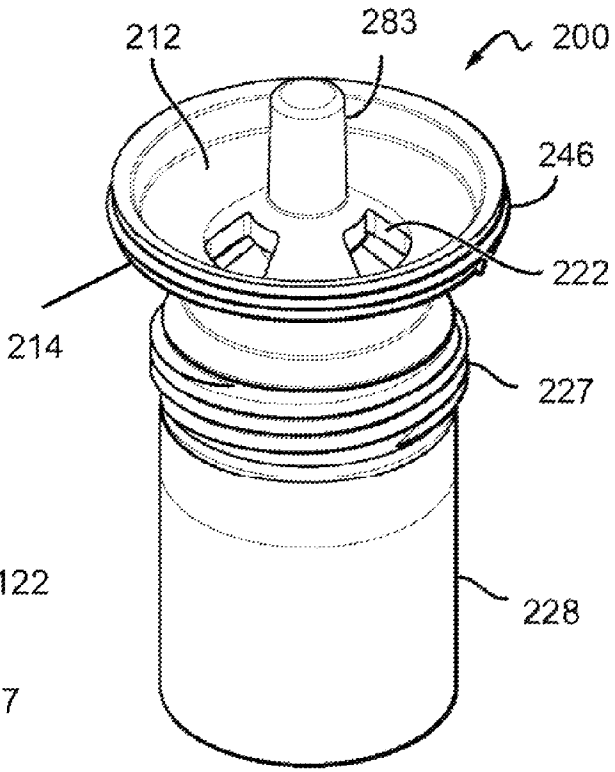
FIG. 2 is a side perspective view of another embodiment of a device for regulating fluid flow through a drain.

FIG. 2 illustrates an alternate embodiment of a device 200 having an extended portion 228. In this manner, a fluid trap can be created when the device 200 is inserted within a drain or cartridge. With respect to the remaining numerals in FIG. 2, the same considerations for like components with like numerals of FIG. 1A apply.

Figure 3:
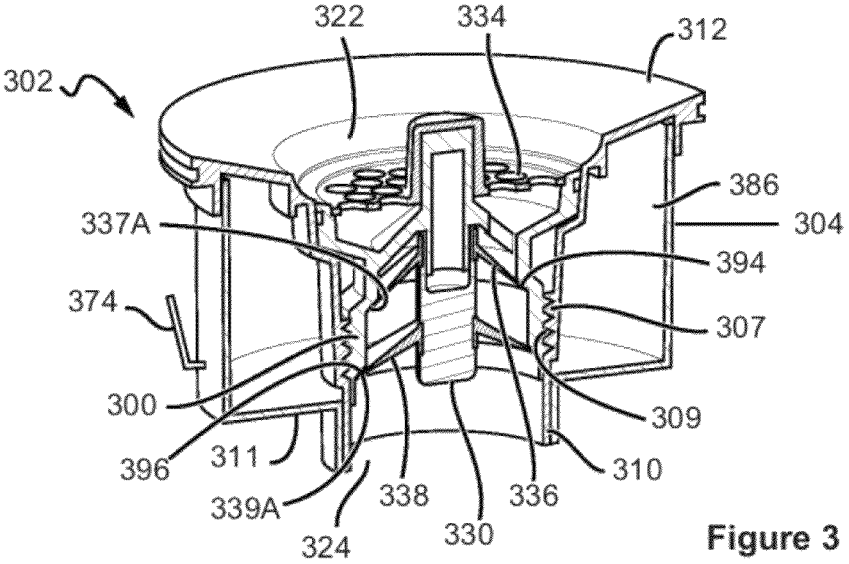
FIG. 3 is a vertical cross-sectional view of an embodiment of a cartridge having a device for regulating fluid flow through a urinal.

In FIG. 3, an embodiment of a device 300 is shown that is disposed within a cartridge 302. The cartridge 302 can include a housing 304 that comprises inner and outer portions 310 and 311, respectively, although it is contemplated that the housing 304 can comprise a single piece. The inner and outer portions 310 and 311 can be permanently affixed to one another to create a hermetically-sealed inner portion 386, which could contain electrical or other components.

Preferably, the device 300 is configured to be user-removable from the housing 304, to provide easy access to device 300 and the drain for maintenance or other needs. In this manner, a user can easily access a drain pipe downstream of the device 300 by removing the device 300. This allows for a plumber's snake or other tool to be ran through the cartridge 302 without requiring removal of the cartridge 302 itself. It is contemplated that each of the housing 304 and device 300 can be composed of any commercially suitable material(s) including, for example, plastics and other polycarbonates, metal, quartz, porcelain, and any combination(s) thereof.

Cartridge 302 is preferably sized and dimensioned to fit within a drain recess, including, for example, drains found in urinals, floor drains and sinks. Although cartridge 302 preferably has a horizontal cross-section that is cylindrical in shape, the shape of cartridge 302 can be varied to correspond to the drain's shape. Alternatively, an adapter (not shown) can be used to adapt the cartridge 302 to the drain's size and dimension. The top 312 of cartridge 302 can include a downward slope to facilitate fluid flow to openings 322.

Device 300 can include threads 309 that are configured to engage with threads 307 disposed on the inner portion 310 of housing 304. In this manner, device 300 can be removably threaded and thereby secured or removed from, housing 304. However, other commercially suitable fasteners could be substituted for threads 307 and 309 such that the device 300 can be removably inserted within housing 304. To ensure an effective seal is maintained between the housing 304 and device 300, one or more o-rings or other commercially suitable flexible seals can be disposed about device 300. Alternatively, such flexible seal could be coupled to housing 304.

Device 300 preferably includes valves 336 and 338 to provide additional protection against the escape of odors from a drain pipe. Preferred valves comprise gravity flow valves that are biased closed such that the valves 336 and 338 are closed when not in use. Each of valves 336 and 338 can comprise a skirt valve, although other commercially suitable gravity flow valves could alternatively be used including, for example, umbrella valves, duck bill valves, and other flexible valves. Valves 336 and 338 can include a flexible, synthetic membrane that can comprise any commercially suitable material(s) including, for example, silicon fabric or other synthetic and/or flexible materials, or combinations thereof, which provide protection to the valves from significant damage or degradation by urine fluids and cleaning solvents. The valves 336 and 338 thereby advantageously can permit urine to pass without allowing downstream odors to permeate up from the drain.

Each of the first and second valves can have an outer edge interval 337A and 339A, respectively. Preferably, the average thickness of the first outer edge interval 337A is less than the average thickness of the second outer edge interval 339A. More preferably, the average thickness of the first outer edge interval 337A is less than 95%, and most preferably, less than 80% of the average thickness of the second outer edge interval 339A.

The second valve 338 can be disposed downstream of the first valve 336. In preferred embodiments, the first and second valves 336 and 338 are separated by a distance less than or equal to six inches, and more preferably, less than or equal to three inches. All commercially suitable configurations are contemplated for the first and second valves 336 and 338, and preferably, the valves 336 and 338 are biased to be convex in the upstream direction. Preferably, the first valve 336 has a rigidity that is greater than a rigidity of the second valve 338.

Valves 336 and 338 are preferably disposed within device 300 rather than cartridge 302, which advantageously allows the valves 336 and 338 to be removed for cleaning or replacement without necessitating removal of the cartridge 302 from a urinal or other drain. In this manner, an interior of the device 300 can define a passageway configured to allow fluid to flow from the first valve 336 to the second valve 338 to the fluid outlet 324. However, it is also contemplated that at least one of valves 336 and 338 could be disposed elsewhere within cartridge 302. It is especially preferred that the valves 336 and 338 can be disposed such that an end portion of the valves 336 and 338 is each seated beneath downwardly-sloping valve seats 394 and 396, respectively. In this manner, any backflow or pressure beneath the valves 336 and 338 will keep the valves 336 and 338 pressed against the respective valve seats 394 and 396, and thus the valves 336 and 338 can remain sealed.

Device 300 can have a stem 330 to which valves 336 and 338 can be coupled. A screen 334 can be coupled to device 300 that includes a plurality of holes such that the screen 334 can filter the fluids flowing to the device 300, and thereby limit the size of objects that can reach valves 336 and 338. The screen 334 is preferably disposed between a cap and valves 336 and 338. Optionally, the screen 334 can function as a tool to assist in removal of the device 300 from the cartridge 302.

To prevent removal of the cartridge 302 from a drain housing, one or more barbs 374, and preferably at least three barbs 374 can extend from the cartridge 302. In this manner, should someone attempt to remove the cartridge 302, the barbs 374 would dig into an inner portion of the drain housing and thereby inhibit removal of the cartridge 302. It is contemplated that the barbs 374 could be composed of stainless steel or any other commercially suitable material(s) such that the barbs 374 have sufficient strength to withstand an applied force of at least 10 N and resist removal of the cartridge 302.

Figure 4A:
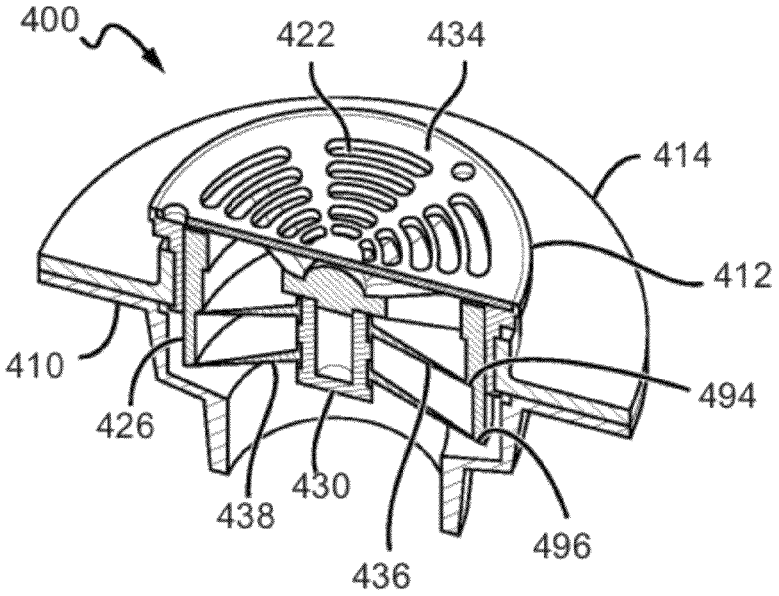
FIGS. 4A-4B are vertical cross-sectional views of one embodiment of a device for regulating fluid flow in a floor drain.
Figure 4B:
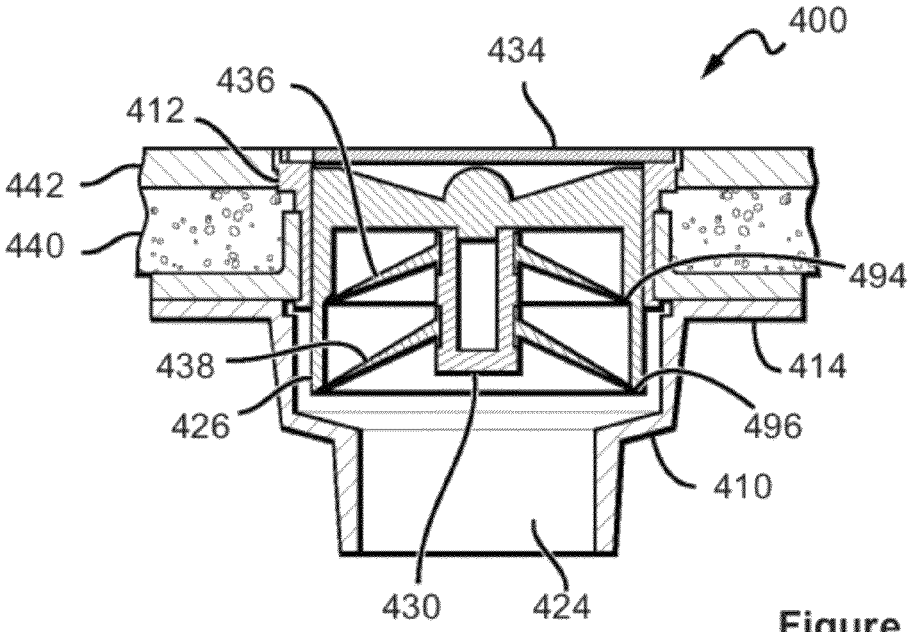

In FIGS. 4A-4B, a floor drain 400 is shown into which a device 426 having first and second valves 436 and 438 can be inserted. The floor drain 400 can comprise a grate 434 having a plurality of drain openings 422 through which water or other fluids can flow, and by which solid objects can be filtered from the fluid flow. The grate 434 can include side 412 that can be removably coupled to the drain housing 410 via threaded portions or other commercially suitable fasteners.

The valves 436 and 438 are preferably gravity flow valves, which are each disposed about a stem 430 disposed in the device 400. In this manner, fluid can flow through openings 422 into the device 426 and past the valves 436 and 438. The fluid can then exit the device 426 through fluid outlet 424.

As shown in FIG. 4B, the floor drain 400 can be disposed within a cement floor 440, such that the grate 434 can be flush with floor tiles 442. The housing 410 of the floor drain 400 can include an outwardly extending portion 414 configured to maintain the position of the housing 410 with respect to the cement 440. It is contemplated that the stem 430 can be coupled directly to the grate 434 such that the device's housing can be eliminated. With respect to the remaining numerals in each of FIG. 4A-4B, the same considerations for like components with like numerals of FIG. 3 apply.

FIGS. 5A-5C illustrate various views of a skirt valve 500 that includes a core 520, and an elongated rim 510 that extends outwardly from the core 520. Preferably, the rim 510 is configured to have a downwardly-sloping surface as the rim 510 extends from core 520. It is especially preferred that the rim 510 is sloped at an angle of 30 degrees, although other angles could be used depending upon the application. In some contemplated embodiments, the core 520 and the rim 510 can be composed of a single piece, although the core 520 and rim 510 could alternatively be separate pieces that are coupled to create a seal therebetween. Although the skirt valve 500 is shown to have a circular shape, all commercially suitable shapes are contemplated including, for example, a square shape, an ovular shape, an icosagon-shape, and a half-circle shape.

Preferably, the rim 510 extends from the core 520 in a 360 degree manner. As shown in FIG. 5C, the rim 510 can be tapered and include an inner portion 512 and an outer edge interval 514. In this manner, the inner portion 512 can have a greater average thickness than the outer edge interval 514, which gives the inner portion 512 additional rigidity, while giving the outer edge interval 514 greater flexibility than the inner portion 512. Thus, unlike umbrella valves of the prior art, at least one-eighth, preferably one-third, more preferably at least one-half, and most preferably, at three three-fourths, of the rim 510 can remain rigid, and provide sufficient strength such as to prevent backflow from flowing upstream through the valve 500.

In an exemplary embodiment, the inner portion 512 of the rim 510 can have an average thickness of between 0.001-0.05 inches, more preferably of between 0.001-0.01 inches, and still more preferably of between 0.001-0.008 inches. Using the same example, the outer edge interval 514 could have an average thickness that is less than 95%, more preferably 90%, 85%, 80%, or 75%, of the average thickness of the inner portion 512. However, the specific average thicknesses of the inner portion 512 and the outer edge interval 514 will depend on the size and dimension of the skirt valve 500, and the specific application.

The core 520 can advantageously include an opening 530 such that the core 520 can be mounted or other affixed to a stem of a cartridge or other valve housing. This advantageously eliminates the need for spokes or other means that extend above the valve 500, which are prone to collecting urine, hair and debris.

Optionally, the skirt valve 500 could include one or more ribs (such as those shown in FIGS. 8A-9B) extending from the core 520 along a portion of the rim 510 to provide additional support to the rim 510.

Figure 6:
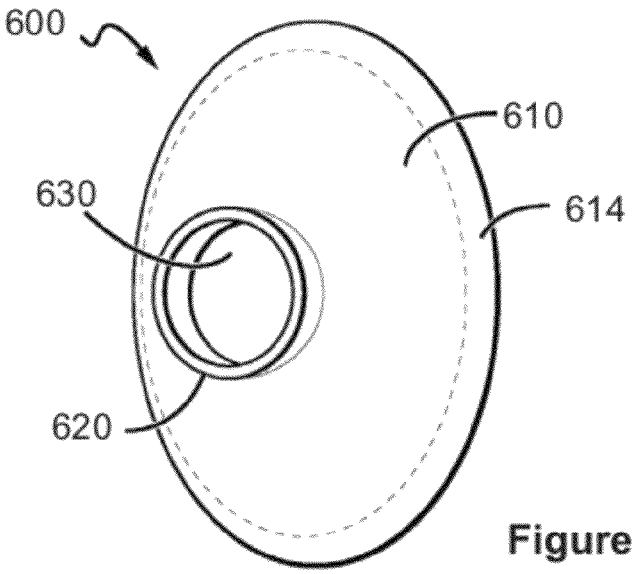
FIG. 6 is a perspective view of an embodiment of a valve.
Figure 7:
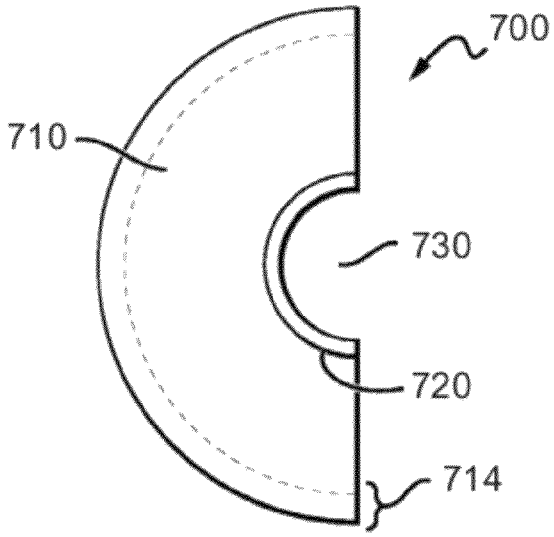
FIG. 7 is a top view of another embodiment of a valve.

In FIG. 6, a valve 600 including a rim 610 that has an ovular horizontal cross-section, and includes an inner portion 612 and an outer edge interval 614. With respect to the remaining numerals in FIG. 6, the same considerations for like components with like numerals of FIGS. 5A-5C apply. FIG. 7 illustrates a valve 700 that includes a rim 710 having a semi-circular horizontal cross-section. With respect to the remaining numerals in FIG. 7, the same considerations for like components with like numerals of FIGS. 5A-5C apply.

Figure 8A:
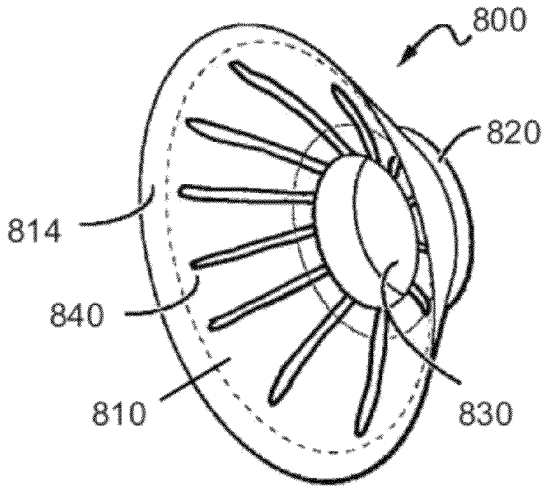
FIGS. 8A-8B and 9A-9B are various embodiments of a skirt valve having ribs.
Figure 8B:
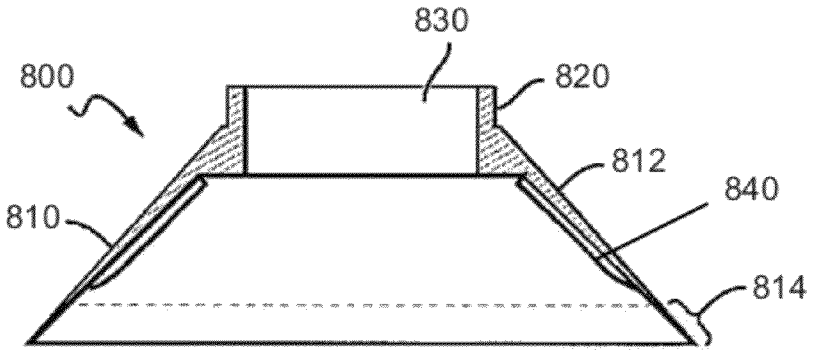

In FIGS. 8A-8B, an embodiment of a skirt valve 800 is shown having a plurality of ribs 840 extending radially from the core 820 to provide additional support to the rim 810. Preferably, the ribs 840 are disposed on a lower (downstream) surface of the valve 800. The addition of ribs 840 is beneficial, especially where the skirt valve 800 has a diameter or length of greater than three inches. In some contemplated embodiments, the ribs 840 could have a diameter of between 0.03-0.1 inches, and more preferably, of between 0.04-0.08 inches. However, the specific thickness of the ribs 840 will depend on the diameter or length of the skirt valve 800, and the specific application. For example, the ribs 840 might be thicker for a skirt valve having a larger diameter, and thinner for a skirt valve having a smaller diameter. With respect to the remaining numerals in each of FIGS. 8A-8B, the same considerations for like components with like numerals of FIG. 5A apply.

Figure 9A:
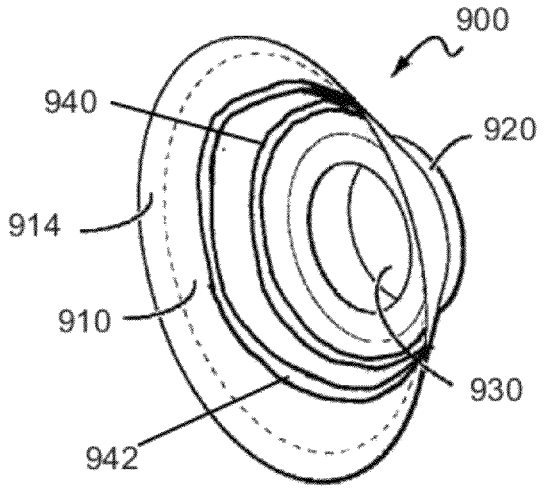
Figure 9B:
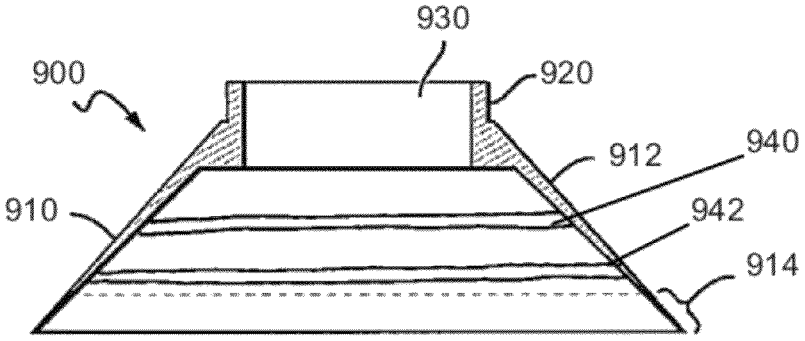

FIGS. 9A-9B illustrate another embodiment of a skirt valve 900 having circular ribs 940 and 942, which are configured to strengthen a rigidity of the valve 900. Although the ribs 940 and 942 are shown having a circular shape, it is contemplated that the shape of the ribs 940 and 942 can vary, especially depending upon the shape of the valve 900. With respect to the remaining numerals in each of FIGS. 9A-9B, the same considerations for like components with like numerals of FIG. 5A apply.

Figure 10:
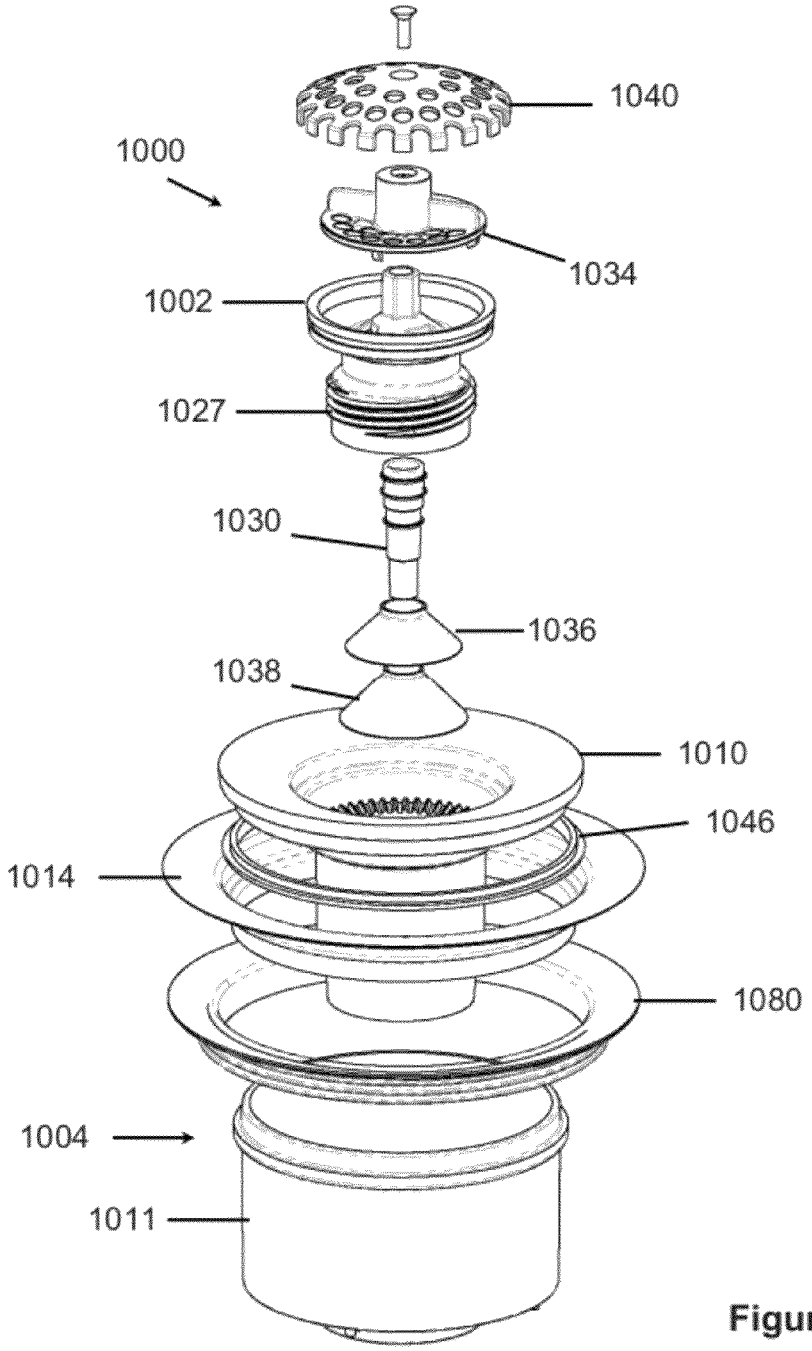
FIG. 10 is an exploded view of an embodiment of a cartridge having a device for regulating fluid flow through a drain.

In FIG. 10, an exploded view of a device 1000 is shown for regulating fluid flow through a drain. Device 1000 can have a housing 1002 that includes threads 1027 configured to mate with threads of cartridge 1004, such that the device 1000 can be removably coupled to the cartridge 1004. Cartridge 1004 can include inner and outer portions 1010 and 1011, respectively, which can be affixed to one another to form the housing of the cartridge 1004. To ensure an effective seal is maintained between the cartridge 1004 and flange 1014, one or more o-rings 1046 or other commercially suitable flexible seals can be disposed about inner portion 1010.

Device 1000 can include a screen 1034 that is removably coupled to the device 1000, and disposed underneath a cap 1040. Cap 1040 preferably has a downwardly tapered outer perimeter that facilities fluid flow to openings in housing 1002, and can be sized and dimensioned to limit splash back of liquid hitting the cap 1040. It is especially preferred that cap is composed of stainless steel although any commercially suitable material(s) could be used. In some contemplated embodiments, cap 1040 can have a tamper proof configuration to help prevent unauthorized removal of the cap 1040 and device 1000. Cap 1040 can include a threaded aperture through which a screw could be inserted to thereby secure the cap 1040 to the device 1000. With respect to the remaining numerals in FIG. 10, the same considerations for like components with like numerals of FIG. 3 apply.

Figure 11A:
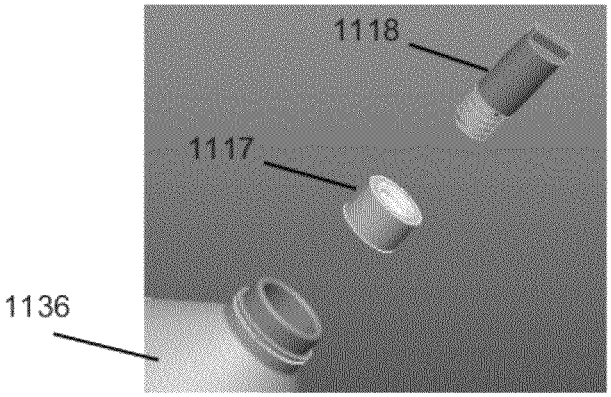
FIG. 11A-11B are an exploded view and a vertical cross-section view, respectively, of an embodiment of a device for regulating fluid flow through a drain.
Figure 11B:
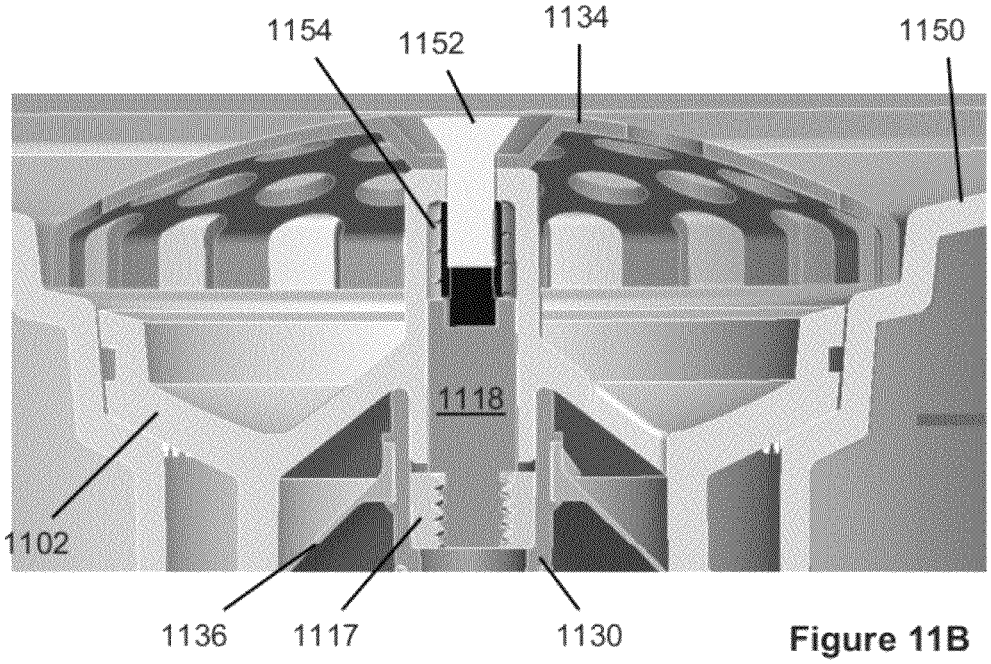

In FIGS. 11A-11B, another embodiment of a device 1100 for regulating fluid flow is shown that is disposed within a drain housing 1150. Device 1100 can further include a stem 1130 to which valves 1136 and 1138 can be coupled. In some contemplated embodiments, the stem 1130 can be coupled to the housing 1102 via sleeve 1117 and top piece 1118. The stem 1130 can be coupled to the sleeve 1117 via adhesive or other commercially suitable fasteners, and is preferably affixed thereto. Top piece 1118 can be coupled to the sleeve 1117 via threads in the sleeve 1117 that mate with threads of the top piece 1118, although other commercially suitable fastener(s) are contemplated. In this manner, the top piece can be removably coupled to the sleeve 1117 and stem 1130. By configuring the stem 1130 to be removable from the housing 1102, the cost of replacing valve 1036 can advantageously be reduced as the housing 1102 need not be replaced.

A screw 1152 can be used to secure a screen 1134 to a stem 1130 of device 1100. The screw 1152 can be inserted into a nut 1154, which is prevented from turning by top piece 1118. Top piece 1118 preferably has a male slot configured such that the slot can lock in a female nut of housing 1102 to eliminate the need for adhesive while preventing the nut from spinning when installing or removing screen 1134.

Device 1100 can be further configured such that rotation of the stem 1130 about its axis causes the stem 1130 to translate upwards or downwards with respect to the housing 1102. This movement advantageously can increase or decrease the tension at the outer edges of the valves 1136 coupled to the stem 1130, which can thereby reduce or increase the flow of fluid past each of the valves. With respect to the remaining numerals in FIG. 11, the same considerations for like components with like numerals of FIG. 10A apply.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A device for regulating a fluid flow through a drain, comprising:

a housing;

an insert that is user-removable from the housing;

downwardly-sloping first valve configured to be biased in a closed position, and having a diaphragm disposed about a post with radially decreasing rigidity; and wherein a bottom surface of the first valve comprises ribs configured to strenghthen the first valve.

2. The device of claim 1, further comprising a downwardly-sloping second valve disposed about the post, downstream of the first valve, and having radially decreasing rigidity.

3. The device of claim 2, wherein the first valve has a first outer 5 mm edge interval having a first average thickness, and the second valve has a second outer 5 mm edge interval having a second average thickness, and wherein the first average thickness is less than 95% of the second average thickness.

4. The device of claim 3, wherein the first average thickness is less than 90% of the second average thickness.

5. The device of claim 2, further comprising a housing that includes the first and second valve seats, and wherein each of the first and second valves is disposed within the housing.

6. device of claim 2, wherein the first and second valves are separated by no more than three inches.

7. The device of claim 2, further comprising a stem coupled to each of the first and second valves.

8. The device of claim 1, wherein the ribs comprise a plurality of radially extending ribs that facilitates the radially decreasing rigidity.

9. The device of claim 1, wherein the first valve has a radially decreasing thickness that facilitates the radially decreasing rigidity.

10. The device of claim 1, further comprising a stem coupled to the first valve, and wherein the stem is disposed through a central portion of the first valve.

11. The device of claim 10, wherein the stem further comprises a first bump, and wherein the first valve is coupled to the stem such that a portion of the first valve is configured to rest upon the first bump.

12. The device of claim 10, wherein the stem further comprises a first recessed portion, and wherein the first valve is disposed in the first recessed portion.

13. The device of claim 1, wherein the first valve is biased to be convex in an upstream direction.

14. The device of claim 1, further comprising an ultraviolet light emitter.

15. A cartridge configured to be inserted into a urinal that includes the device of claim 1.

16. A urinal that includes the device of claim 1.

17. A floor drain that includes the device of claim 1.

* * * * *